US006231357B1

(12) United States Patent
Rumsey

(10) Patent No.: US 6,231,357 B1
(45) Date of Patent: May 15, 2001

(54) WATERPROOF HIGH VOLTAGE CONNECTOR

(75) Inventor: Roger L. Rumsey, Wichita, KS (US)

(73) Assignee: Relight America, Inc., Wichita, KS (US)

( * ) Notice: Subject to any disclaimer, the term of this patent is extended or adjusted under 35 U.S.C. 154(b) by 0 days.

(21) Appl. No.: 09/596,974

(22) Filed: Jun. 20, 2000

Related U.S. Application Data

(60) Continuation-in-part of application No. 09/455,185, filed on Dec. 6, 1999, which is a division of application No. 09/009,168, filed on Jan. 20, 1998, now Pat. No. 5,998,736

(60) Provisional application No. 60/176,268, filed on Jan. 14, 2000.

(51) Int. Cl.[7] ..... H01R 4/66

(52) U.S. Cl. ..... 439/95; 174/54 R

(58) Field of Search ..... 439/95, 98, 99, 439/610, 101, 108, 939, 620

(56) References Cited

U.S. PATENT DOCUMENTS

| | | | | |
|---|---|---|---|---|
| 2,245,681 | | 6/1941 | Kenigsberg | 40/130 |
| 2,904,619 | * | 9/1959 | Forney, Jr. | 174/88 |
| 3,142,721 | | 7/1964 | Long | 174/65 |
| 4,090,029 | | 5/1978 | Lundeberg | 174/51 |
| 4,590,950 | * | 5/1986 | Iwaszkieicz et al. | 128/786 |
| 4,613,199 | * | 9/1986 | McGeary | 339/177 R |
| 4,662,693 | * | 5/1987 | Hunter et al. | 339/177 R |
| 4,690,482 | | 9/1987 | Chamberland et al. | 439/578 |
| 4,737,601 | | 4/1988 | Gartzke | 174/152 |
| 4,820,174 | * | 4/1989 | Farrar et al. | 439/95 |
| 4,842,535 | | 6/1989 | Velke, Sr. et al. | 439/232 |
| 5,042,904 | * | 8/1991 | Storey et al. | 385/105 |
| 5,062,808 | * | 11/1991 | Hosler, Sr. | 439/580 |
| 5,066,248 | * | 11/1991 | Gaver, Jr. et al. | 439/578 |
| 5,166,477 | * | 11/1992 | Perin, Jr. et al. | 174/74 R |
| 5,214,243 | | 5/1993 | Johnson | 174/36 |
| 5,217,392 | | 6/1993 | Hosler, Sr. | 439/585 |
| 5,388,584 | * | 2/1995 | King | 128/662.06 |
| 5,439,386 | | 8/1995 | Ellis et al. | 439/322 |
| 5,574,815 | * | 11/1996 | Kneeland | 385/101 |
| 5,590,950 | | 1/1997 | Hildebrand | 362/109 |
| 5,597,322 | * | 1/1997 | Inaba et al. | 439/578 |
| 5,645,450 | | 7/1997 | Yamada et al. | 439/585 |
| 5,773,759 | | 6/1998 | Hablutzel | 174/65 R |
| 5,890,929 | * | 4/1999 | Mills et al. | 439/610 |
| 5,934,937 | * | 8/1999 | McCarthy | 439/583 |
| 5,955,445 | * | 9/1999 | Deitz, Sr. et al. | 385/100 |
| 6,010,788 | * | 1/2000 | Kebabjian et al. | 428/381 |
| 6,089,903 | * | 7/2000 | Gray et al. | 439/439 |

* cited by examiner

*Primary Examiner*—Gary F. Paumen
*Assistant Examiner*—Phuongchi Nguyen
(74) *Attorney, Agent, or Firm*—Head, Johnson & Kachigian

(57) ABSTRACT

For use with a flexible cable having a central current carrying electrical conductor, a symmetrical layer of insulation concentrically surrounding the central conductor, a symmetrical circumferential layer of shielding conductor surrounding the layer of insulation, and a symmetrical outer sheath of insulation surrounding the shielding conductor, a wiring system formed of a fitting of conductive material having a passageway therethrough that receives the flexible cable, a short length shield connector of bare conductive metal having a first portion inserted through an opening in the flexible cable outer sheath of insulation to conductively engage the cable circumferential layer of shielding conductor and having a second portion that remains exterior of the flexible cable outer sheath of insulation; and a short length electrically conductive tubular ground ring slidably received on the cable and overlying a portion of the shield connector, the ground ring being crimpable whereby when crimped it securely engages the exterior of the cable and the shield connector, the fitting being slidably positioned over the ground ring, continuity thereby being provided from the cable shielding conductor through the shield connector and the ground ring to the fitting.

5 Claims, 2 Drawing Sheets

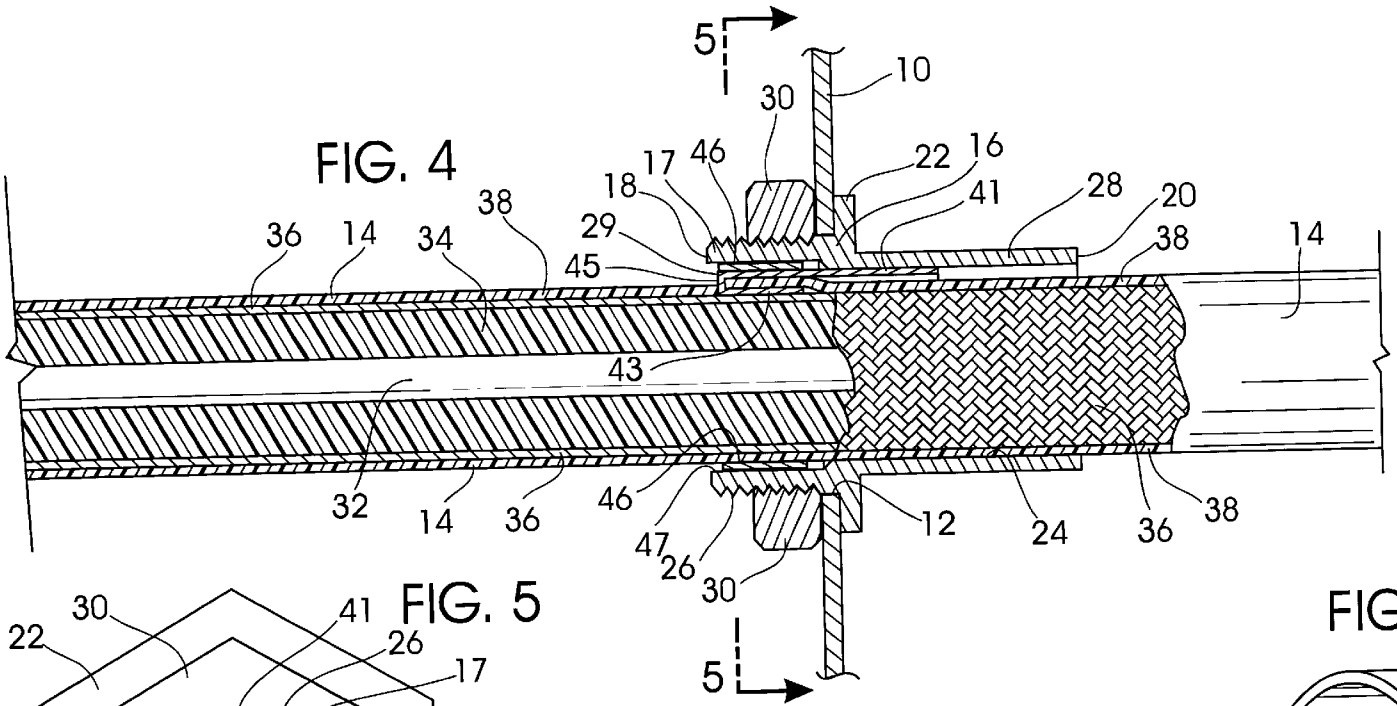
FIG. 4
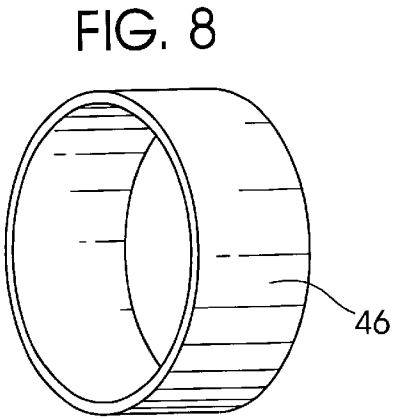
FIG. 8
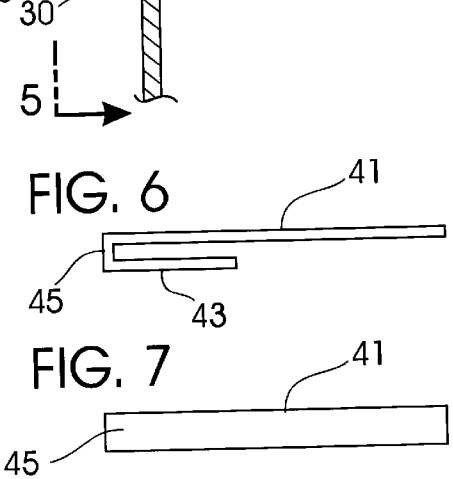
FIG. 6
FIG. 7
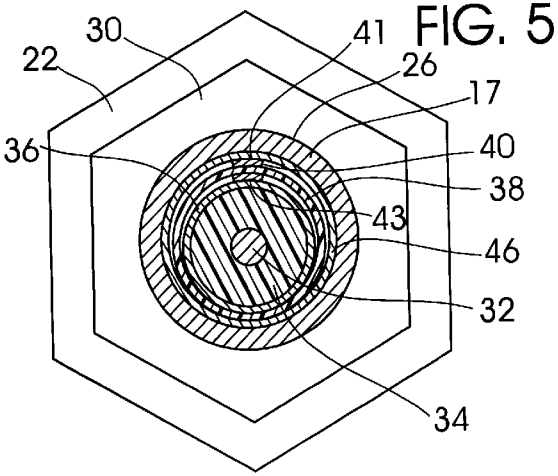
FIG. 5

WATERPROOF HIGH VOLTAGE CONNECTOR

REFERENCE TO PENDING APPLICATIONS

This is a formal application based on Provisional Application No.60/176,268, filed Jan. 14. 2000 entitled, HIGH VOLTAGE WIRING SYSTEM FOR NEON LIGHTS that is a continuation-in-part of U.S. patent application Ser. No. 09/455,185 filed on Dec. 6, 1999 entitled A SHIELDED WIRING SYSTEM FOR HIGH VOLTAGE AC CURRENT, which is a divisional of U.S. patent application Ser. No. 09/009,168 entitled A HIGH VOLTAGE WIRING SYSTEM FOR NEON LIGHTS, filed Jan. 20, 1998 and now U.S. Pat. No. 5,998,736 issued Dec. 7, 1999.

BACKGROUND OF THE INVENTION

This invention relates to a waterproof high voltage wiring and connector system particularly useful in wiring neon lights.

Luminous gaseous signs have been used for many years. While such signs can employ a variety of gases, the most popular and effective signs use neon gas and are referred to as "neon signs". Neon signs are typically formed of glass tubing that is evacuated of substantially all of the air therein and refilled with neon gas. A conductive probe is inserted into each of the opposed ends of the tube. When high voltage energy is applied to the opposed ends of a neon filled tube, the neon gas is excited and produces visible electromagnetic radiation. The glass tubes can be of varying diameters and can easily be conformed to replicate letters, numbers and designs. The visible spectrum of light provided by excited neon gas is relatively bright and attractive; therefore the use of neon signs has become exceedingly popular in the United States and other countries of the world.

A serious problem that arises with the use of neon signs is the danger of fire and high voltage shock to workman who install or repair them. The typical neon sign transformer in the United States can be powered by standard household current, that is, 120V 60 Hz AC but the voltage typically supplied by the transformer and applied to neon signs is approximately 15,000V 60 Hz AC. This high voltage is dangerous to workman and any other living organism that may come in contact with the wiring for the neon sign. Further, this high voltage is also frequently the cause of building fires. Fifteen thousand volts AC readily arcs across adjacent conductors or from a conductor to a ground and such arcing can ignite combustible materials. The danger of fire as a consequence of this high voltage has become of such concern that some municipalities discourage the use of neon signs. In some cases, neon signs are being replaced by other types of signs that do not require high voltage electrical current.

Others have provided electrical fittings and wiring systems that are useful to supply high voltage electrical current, such as for connecting neon signs. For background information relating to other systems, reference may be made to the following United States patents:

| U.S. Pat. No. | INVENTOR | TITLE |
|---|---|---|
| 2,245,681 | Kenigserg | Interchangeable Unit Luminous Gaseous Sign |
| 3,142,721 | Long | Connector for Joining the Outer Conductor of a Coaxial Cable to a Wall |
| 4,090,029 | Lundeberg | Liquid Tight Connector with Improved Ground Conductivity |
| 4,590,950 | Iwaszkiewicz et al. | Electrical Connection |
| 4,690,482 | Chamberland et al. | High Frequency, Hermetic, Coaxial Connector for Flexible Cable |
| 4,737,601 | Gartzke | Hermetically Sealed Electrical Feedthrough and Method of Making Same |
| 4,842,535 | Velke, Sr. et al | Gas Tube Electrode Connector |
| 5,166,477 | Perin, Jr. et al | Cable and Termination For High Voltage and High Frequency Applications |
| 5,214,243 | Johnson | High-Temperature, Low-Noise Coaxial Cable Assembly With High Strength Reinforcement Braid |
| 5,217,392 | Hosler, Sr. | Coaxial Cable-to-Cable Splice Connector |
| 5,439,386 | Ellis et al | Quick Disconnect Environmentally Sealed RF Connector For Hardline Coaxial Cable |
| 5,645,450 | Yamada et al. | Shielded Connector |
| 5,773,759 | Hablutzel | Screw-Type Conduit Fitting for a Shielded Cable |

BRIEF SUMMARY OF THE INVENTION

The invention is concerned with a waterproof high voltage wiring and connector system for transferring high voltage electrical AC current from a high voltage power source to an apparatus, such as a neon sign. When the apparatus is a neon sign, the typical high voltage transformer may, as an example, employ a primary winding activated by 120V 60 Hz AC as is commonly used in the United States. The transformer converts the 120V 60 Hz AC electrical energy into high voltage 60 Hz electrical energy typical in a range of about 15,000 volts. This disclosure provides a waterproof connector useful in systems for safely conducting high voltage to individual segments of a neon sign.

This invention is basically concerned with a wiring and connector system by which a high voltage AC current is transported from a two pole high voltage transformer to a neon sign, one pole of the transformer being at ground potential and the other pole of the transformer being at a high AC voltage relative to ground. The system employs a flexible cable having in cross-section: (a) a central current carrying electrical conductor; (b) a symmetrical layer of insulation concentrically surrounding the central conductor; and (c) a symmetrical circumferential layer of metallic woven shielding conductor surrounding the layer of insulation. The cable usually also has an outer layer of plastic or rubber insulation.

An important application of the connector to be described is for passing high voltage through a metal wall having an opening therethrough. A short length cylindrical pass-through body has a nominal external diameter less than that of the opening. The pass-through body has a first end and second end. Spaced between the first and second ends of the pass-through body is an integral enlarged external diameter flange. An integral tubular first portion extends from the flange to the body second end and a tubular second portion extends from the flange to the body second end. External threads are provided on the exterior of the pass-through body first portion. A coaxially insulated conductor extends through the pass-through body. A ground conducting lug is centered within the pass-through body. The tubular second portion of the pass-through body is then crimped (compressed) to make permanent contact with the ground shield connection and also to form strain relief for the completed cable system.

The first tubular portion of the pass-through body that is externally threaded receives a nut by which the pass-through fitting can be secured in an opening in a device.

The ground conducting lug provides continuity between the metallic woven shielding conductor of the cable and the pass-through body. The ground conducting lug is formed of an elongated thin strip of highly conductive material, such as copper. An opening is cut into the cable outer insulation sheathing. A U-shaped bent inner portion of the ground conducting lug is inserted through the opening so as to lie against the outer surface of the cable metallic woven shielding conductor to thereby provide electrical communication between the cable shielding conductor and the pass-through connector.

Positioned over an outer portion of the ground conducting lug and surrounding the cable is a ground ring, that is, a ring of conductive material dimensioned to be easily slid over the exterior of the cable. The ground ring, after being positioned over the external part of the ground conducting lug and over the U-shaped inner part of the lug that is within the outer insulation sheathing of the cable is mechanically crimped to shrink it in diameter around the exterior of the cable and to secure electrical contact with the ground conducting lug. After the ground ring is crimped the pass-through fitting is slid over it so that the ground ring is positioned within the pass-through fitting.

After the pass-through fitting is slid over the installed crimped ground ring the thin wall integral second tubular portion of the pass-through body is itself crimped against the exterior of the cable. The crimped portion engages the ground conducting lug so that the pass-through body is then in electrical continuity with the metallic woven jacket of the cable.

The combination of a crimped ground ring and a crimped pass-through body provides an improved fitting for the neon sign industry. The cable resists pull from the pass-through body. Further, a waterproof closure is obtained around the cable.

A better understanding of the invention will be obtained from the following description of the preferred embodiments taken in conjunction with the attached drawings.

DESCRIPTION OF THE DRAWINGS

FIG. 4 is an elevational cross-sectional view of am improved pass-through fitting having a high voltage cable received therein.

FIG. 5 is a cross-sectional view of the fitting and cable taken along the line 5—5 of FIG. 4.

FIG. 6 is an elevational view of a ground conducting lug as employed in the fitting of FIGS. 4 and 5.

FIG. 7 is a top plan view of the ground conducting lug taken along the line 7—7 of FIG. 6.

FIG. 8 is an isometric view of a ground ring as employed in the fitting of FIGS. 4 and 5.

DETAILED DESCRIPTION OF THE PREFERRED EMBODIMENTS

Figure 1:
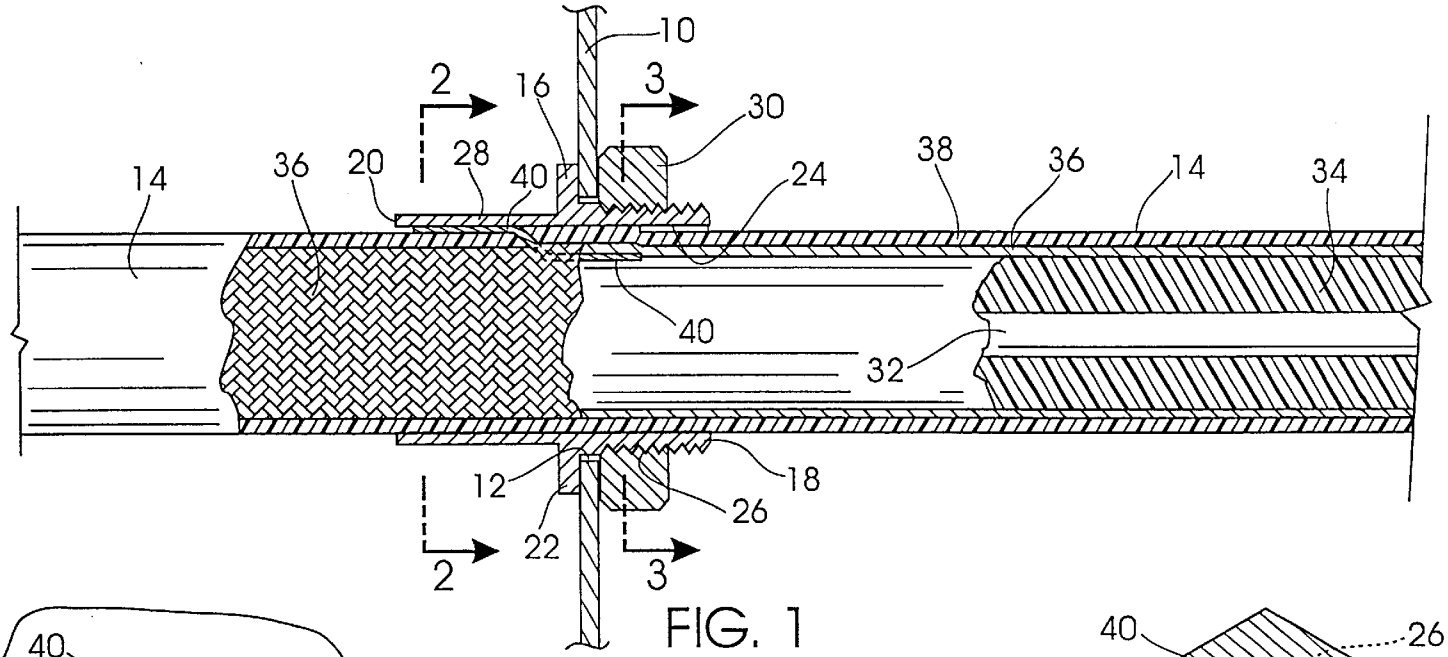
FIG. 1 is an elevational cross-sectional enlarged view of a pass-through fitting showing its use in passing a high voltage cable through an opening in a metal wall.
Figure 3:
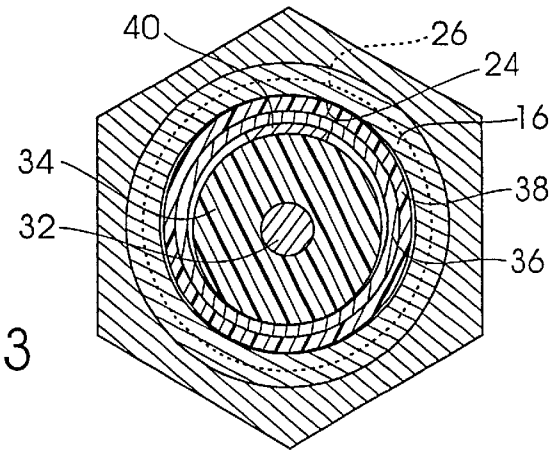
FIG. 3 is an elevational cross-sectional view of the pass-through fitting as taken along the line 3—3 of FIG. 1.
Figure 2:
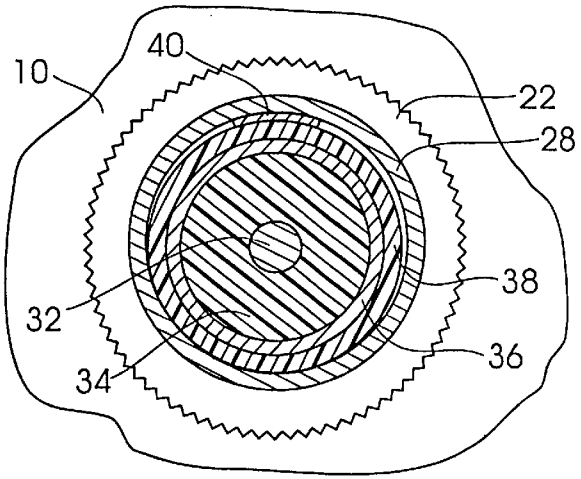
FIG. 2 is an elevational cross-sectional view of the pass-through fitting as taken along the line 2—2 of FIG. 1.

This invention is concerned with a waterproof high voltage connector that is particularly useful in neon power cabling for transferring high voltage electrical energy from a high voltage source, typically a transformer, to one or more electrical energy consuming devices, such as neon light tubes. FIGS. 1, 2 and 3 illustrates one embodiment of the system that employs a pass-through assembly or a pass-through connector that is useful for passing high voltage electrical energy through a wall and illustrates a means of providing electrical continuity and electromagnetic field shield continuity through the wall. The device when installed as shown in FIGS. 1, 2 and 3 also insures that a positive ground path is established with the wall. These Figures show a metallic wall 10 of an energy producing or consuming device. Wall 10 has an opening 12 therein. The objective is to pass through opening 12 a cable 14 in a way to maintain a substantially uniform electromagnetic field and insure a positive ground path from a ground conductor within the cable to wall 10.

Received within opening 12 is a pass-through fitting 16 having a first end 18, a second end 20, an intermediate flange section 22 and a central opening 24 extending therethrough. Integral outwardly extending flange 22 separates the first end portion and the second end portion of the fitting. External threads 26 are formed on the fitting body extending from flange 22 to first end 18. Integrally extending from flange 22 to second end 20 is a reduced external diameter tubular portion 28. To retain pass-through fitting 16 within opening 12, nut 30 is employed. Wall 10 is captured between flange 22 and nut 30.

Cable 14 includes a central conductor 32 having inner insulation 34 thereon, the insulation being surrounded by a metallic woven jacket 36. An outer insulating sheathing 38 surrounds the metallic woven jacket.

Extending through a small slit in the cable outer insulating sheathing 38 is an inner portion of a ground/shield connection 40. Ground/shield connection 40 has an external portion that is positioned within fitting tubular portion 28. After cable 14 and ground/shield connection 40 are placed in the fitting 16 as shown in FIG. 1, tubular portion 28 is externally compressed, that is, crimped. Crimping of tubular portion 28 of fitting 16 provides a positive electrical connection between the fitting and cable ground/shield 40 and provides positive strain relief for the cable relative to wall 10.

Further, and of most significance, ground shield connection 40 electrically grounds metallic jacket 36 of cable 14 to pass-through fitting 16 and thereby to wall 10.

By arranging a high voltage wiring system for neon signs wherein the electric field is maintained concentric to the high voltage conductor throughout the system and wherein the possibility of a point of concentration of the electric field is eliminated or at least substantially minimized, the possibility of failure of the wiring system is greatly reduced. The pass-through connector of FIGS. 1, 2 and 3 demonstrate how a system can be constructed so that throughout the entire system, including connections, pass-throughs and so forth, lines of electric field force are concentrically maintained. Thus, the possibility of failure of the high voltage wiring system for a neon sign is substantially reduced.

FIGS. 4–8 illustrate an improved embodiment of the invention as shown in FIGS. 1–3 in which the same numerals are employed for comparable elements. A portion of a wall of a piece of equipment is illustrated by numeral 10, the wall being of metal and having an opening 12 therein. The invention provides a connector for passing a high voltage cable 14 through wall 10 by way of opening 12. Cable 14 includes a primary conductor 32 that is surrounded by inner insulation 34. Around inner insulation 34 is a metallic woven jacket 36 that serves as a shielding conductor. On the exterior of woven jacket 36 an outer insulation, usually plastic sheathing, is formed. Cable 14 including elements 32, 34, 36 and 38 as has been previously described with reference to FIGS. 1, 2 and 3, is a typical high voltage conductor and is characteristic of high voltage conductors employed, in the neon sign industry. The cable 14 is a single conductor that typically includes only one primary conductor 32 as compared with a type of wiring utilized for transmitting a low voltage electrical current of the type employed for wiring buildings, including homes. In the typical wiring for neon lights, one pole of a high voltage circuit is connected to central conductor 32 while the other pole is connected to ground. That is, the return path of an electrical circuit employing cable 14 is by ground. Further, the metallic woven jacket 36 of cable 14 is typically connected to ground and provides one return ground path for current flow.

The connector used to extend cable 14 through wall 10 is a pass-through tubular fitting 16 that has a first end 18 and a second end 20. Intermediate the ends is a radially extending flange 22. Between flange 22 and first end 18 is a tubular body portion 17 that is provided with external threads 26.

Received on tubular body portion 17 is a nut 30 that holds the fitting flange 16 in electrical and physical contact with wall 10 and thereby secures cable 14 in relationship to wall 10.

Extending between flange 22 and second end 20 of fitting 16 is a tubular portion 28 that has a wall thickness less than that of the tubular body portion 17. The tubular portion 28 is configured to be mechanically crimped to the exterior of cable 14. The mechanical crimping of tubular portion 28 can take place before or after fitting 16 is installed in opening 12 of wall 10. In one way of practicing the invention, the weatherproof high voltage connector as shown in FIG. 4 is attached to the length of cable 14 at a factory, or a shop, before the cable with the attached connector is brought to a job site. In another way of practicing the invention, the cable can be secured within the fitting and the tubular portion 28 crimped at the job site. There are advantages in providing an assembly that is, a length of cable having secured to it a fitting in a factory or shop rather than the assembly operation taking place on the job since in a factory or shop the quality control can be more carefully monitored.

A feature of pass-through fitting 16 that forms the waterproof high voltage connector is that it is grounded or has continuity with metallic woven jacket 36 of cable 14. This is accomplished by cutting a small slit at a location identified by the numeral 29 in FIG. 4 in the outer insulation sheathing 38 of cable 14. The small slit cuts the outer insulation 38 but does not cut woven metal jacket 36. A ground conducting lug 40A is employed to provide a conducting path between metal woven jacket 36 of cable 14 and fitting 16. A ground conducting lug 40A, as shown in FIGS. 6 and 7, is a unitary length of relatively thin elongated electrically conducting metallic strip, typically formed of copper. The ground conducting lug 40A can initially be in the shape of an elongated narrow relatively thin piece of copper or similar metal that is bent into a U-shaped or hook arrangement as shown in FIG. 6 to have a long leg 41 and a short leg 43 that is bent back parallel to leg 41, with an integral bight portion 45 therebetween.

After the small slit 29 is cut in cable outer insulation sheathing 38 the short leg portion 43 of grounding lug 40A is inserted through the slit and the ground conducting lug is positioned so that the bight portion 45 extends through the slit with the short leg portion 43 lying in contact with an external surface of woven metal jacket 36 and with the long leg portion 41 lying in contact with the external surface of the cable outer insulation sheathing 38.

The embodiment of FIGS. 4–8 employs an additional element that is not used in the embodiment of FIGS. 1, 2 and 3 and that is, a ground ring 46 that is illustrated isometrically in FIG. 8. The ground ring is a short length tubular member that normally has an internal diameter greater than the external diameter of cable 14 so that the ground ring can be slid over the cable 14. The ground ring 46 is a tubular member of relatively thin highly conductive metal such as copper. After the ground conducting lug 40A is installed through a slit cut at 29 in the outer installation sheathing 38 of cable 14 the ground ring 46 is slid into position to overlay short leg 43 and a portion of the long leg 41 of ground conducting lug 40A. The ground ring 46 is then crimped that is, it is circumferentially compressed and distorted to cause it to conform tightly about cable 14 and about ground conducting lug 40A.

After the ground conducting lug 40A is installed on cable 14 and the ground ring crimped in position as indicated, fitting 16 can then be slid in position as shown in FIG. 4 so that the tubular body portion 17 of the fitting overlays ground ring 46. Fitting tubular portion 28 overlays a portion of the long leg 41 of the ground conducting lug.

While fitting 16 can be formed with a constant internal diameter, in the preferred embodiment, as illustrated, the fitting has two concentric internal diameters that is, the tubular portion 28 has a central opening 24 with a given internal diameter while the fitting tubular body portion 17 has a slightly enlarged internal diameter 47. The slightly enlarged diameter 47 allows the fitting to be slid over the crimped ground ring 46. The internal diameter of central opening 24 is such as to be snug but slidable on cable 14 with sufficient clearance to receive the outer end of the ground lug long leg 41 as shown in FIG. 4.

When ground conducting lug 40A has been installed in cable 14 and ground ring 46 is positioned and crimped, fitting 16 is slidably positioned in place as shown in FIG. 4 and then fitting tubular portion 28 is crimped by application of a crimping tool to its exterior surface. Crimping of fitting tubular portion 28 securely locks it in place on cable 14 and securely establishes electrical continuity between ground conducting lug 40A and the fitting 16. Thus the continuity between the metal woven jacket 36 of cable 14 and fitting 16 is positively established by ground paths augmented by crimped ground ring 46 and crimped tubular portion 28 of the fitting. Further, the crimping of tubular portion 28 forms a watertight compression of the fitting tubular portion 28 against the external surface of cable 14. The fitting, when installed in the method described, is securely attached to the external surface of cable 14 in a way that resists slidable displacement of the fitting relative to the cable that is, the fitting when installed has a high pull resistance load and at the same time a waterproof contact is made between the central opening 24 of the fitting and the exterior of cable 14.

Thus the waterproof high voltage connector system as shown in FIGS. 4–8 is an improvement to the basic high voltage wiring system as shown in FIGS. 1–3. The differences between the embodiment of FIGS. 1–3 and that of FIGS. 4–8 is that the latter embodiment provides an increased load resistance that is, the fitting can tolerate a higher force tending to pull cable 14 out of connector 16 and at the same time, the resistance against the passage of water through the connector is substantially increased.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A shielded wiring system for high voltage AC current comprising:

a flexible cable having a central current carrying electrical conductor, a symmetrical layer of insulation concentrically surrounding said central conductor, a symmetrical circumferential layer of shielding conductor surrounding said layer of insulation and a symmetrical outer sheath of insulation surrounding said shielding conductor;

a fitting of conductive material having a passageway therethrough that receives said flexible cable therein, a short length shield connector of bare conductive metal having a first portion inserted through an opening in said flexible cable outer sheath of insulation to conductively engage said cable circumferential layer of shielding conductor and having a second portion that remains exterior of said flexible cable outer sheath of insulation; and a short length electrically conductive tubular ground ring slidably received on said cable and overlying a portion of said shield connector, the ground ring being crimpable whereby when crimped it securely engages the exterior of said cable and said shield connector, said fitting being slidably positioned over said ground ring, continuity thereby being provided from said cable shielding conductor through said shield connector and said ground ring to said fitting.

2. A shielded wiring system for high voltage AC current according to claim 1 in which said fitting has an integral tubular portion providing a portion of said passageway that receives said cable, said second portion of said shield connector engaging said fitting integral tubular portion and said fitting integral tubular portion being compressible by means of crimping to thoroughly contact said shield connector and to thereby thoroughly ground said fitting to said cable circumferential layer of shielding conductor.

3. A shielded wiring system according to claim 1 wherein said passageway through said fitting has one portion of first internal diameter and a second portion of a second, enlarged internal diameter that slidably receives said ground ring.

4. A shielded wiring system according to claim 1 wherein said shield connector first portion is bent in U-shaped fashion to extend parallel to said second portion, the first portion being inserted through said opening in said flexible cable outer sheath of insulation to conductively engage said cable circumferential layer of shielding conductor.

5. A shielded wiring system according to claim 4 wherein said ground ring overlies both said shield connector first and second portions.

* * * * *